US007972199B2

(12) United States Patent
Blatz et al.

(10) Patent No.: US 7,972,199 B2
(45) Date of Patent: Jul. 5, 2011

(54) HAND-HELD POWER TOOL WITH LOCKING NUT

(75) Inventors: Thomas Blatz, Kaufering (DE); Joachim Guenther, Kaufering (DE); Roland Meuer, Ettringen (DE); Friedemann Moeller, Munich (DE); Klaus Nagelschmied, Germering (DE)

(73) Assignee: Hilti Aktiengesellschaft, Schaan (LI)

( * ) Notice: Subject to any disclaimer, the term of this patent is extended or adjusted under 35 U.S.C. 154(b) by 353 days.

(21) Appl. No.: 12/316,075

(22) Filed: Dec. 8, 2008

(65) Prior Publication Data

US 2009/0156108 A1 Jun. 18, 2009

(30) Foreign Application Priority Data

Dec. 12, 2007 (DE) ..... 10 2007 055 775

(51) Int. Cl.
*B24B 23/00* (2006.01)

(52) U.S. Cl. ..... 451/359; 451/508

(58) Field of Classification Search ..... 451/359, 451/508, 509
See application file for complete search history.

(56) References Cited

U.S. PATENT DOCUMENTS

| | | | | |
|---|---|---|---|---|
| 5,207,028 | A * | 5/1993 | Timmons | 451/342 |
| 5,464,365 | A * | 11/1995 | Kirn | 451/359 |
| 7,357,702 | B2 * | 4/2008 | Ficai | 451/508 |
| 2003/0114092 | A1 * | 6/2003 | Rupprecht et al. | 451/359 |

* cited by examiner

*Primary Examiner* — Robert Rose
(74) *Attorney, Agent, or Firm* — Abelaman, Frayne & Schwab

(57) ABSTRACT

A hand-held power tool includes a drive spindle (2) rotatable about a rotational axis (A) and provided at its free end with a clamping flange (3) and a locking thread (4) having at least one thread undercut (8), and a locking nut (7) tightenable on the locking thread (4) for securing a disc-shaped tool (5) between its clamping surface (6) and the clamping flange (3) of the drive spindle (2), with the thread undercut (8) having an axial length that corresponds to at least an axial length of an inner thread (9) of the locking nut (7).

4 Claims, 1 Drawing Sheet

HAND-HELD POWER TOOL WITH LOCKING NUT

BACKGROUND OF THE INVENTION

1. Field of the Invention

The present invention relates to a hand-held power tool with a locking nut for securing a disc-shaped tool and, in particular, to angle grinder, hand-held jointer saw, or hand-held circular saw.

2. Description of the Prior Art

Conventional tool holders for a disc-shaped tool (under which in addition to flat discs, also plate-shaped tools are understood) frictionally secure the disc-shaped tool on the rotatable drive spindle between a clamping flange provided on the drive spindle and a locking nut that is screwed onto the drive spindle. The thread direction of the locking thread provided on the drive spindle is usually so selected that the locking nut automatically tightens upon actuation of the power tool or start up of the operation. A drive spindle provided with a locking thread on its free end is disclosed in German Publication DE 311 09 12.

Contemporary hand-held power tools with safety routines provide for sudden braking of the drive spindle up to a complete stop. In order to reliably prevent an inadvertent loosening of the locking nut and/or of the disc-shaped tool in case when the locking nut becomes loose due to its inertia upon a sudden stop of the spindle, German Publication DE 42 38 466 discloses locking means that in addition to a locking nut, includes additional clamping means that applies pressure to the disc-shaped tool and is preloaded against a locking nut with a plate spring.

An object of the present invention is to provide a reliable tool holder for a disc-shaped tool and that includes a locking nut.

SUMMARY OF THE INVENTION

This and other objects of the present invention, which will become apparent hereinafter are achieved by providing a hand-held power tool including a drive spindle rotatable about a rotational axis and provided at its free end with a clamping flange and a locking thread and a locking nut having a clamping surface and tightenable on the locking thread for securing a disc-shaped tool between the clamping flange of the drive spindle and the clamping surface of the locking nut, with the locking thread having at least one undercut an axial length of which corresponds to at least an axial length of an inner thread of the locking nut.

With the thread undercut, the locking nut can be removed only by its manual advancement in the end-side section of the locking thread and, thus, in particular, not as a result of an inertia-induced free displacement within the thread undercut. Thus, the locking nut itself and, thereby, the disc-shaped tool, are axially fixedly secured on the drive spindle even in the case when the locking nut would have become loose due to inertia. This provides for integration of the locking nut with the drive spindle, without a possibility of the locking nut being lost.

Advantageously, the clamping flange has a centering collar, which insures fixation of the disc-shaped tool in a precise radial position.

Further advantageously, the locking nut has on its side adjacent to the disc-shaped tool, an inner recess in which the centering collar of the clamping flange can be received.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
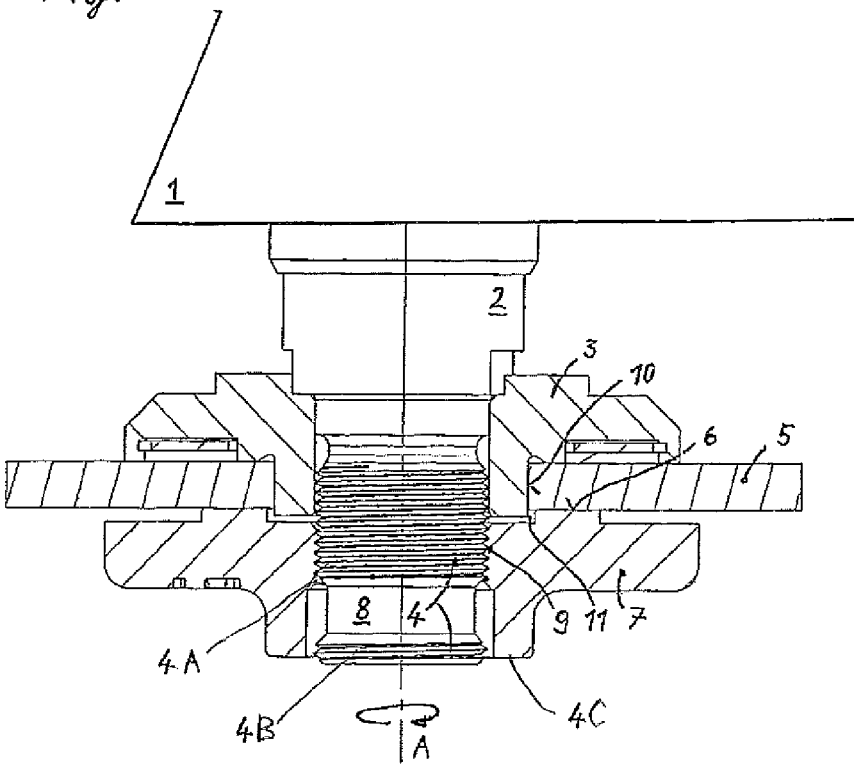
FIG. 1 a longitudinal cross-sectional view illustrating securing of a disc-shaped tool to a hand-held power tool.

A hand-held power tool 1, which schematically shown in FIG. 1, includes a drive spindle 2 rotatable about a rotational axis A, a clamping flange 3 formlockingly secured on an end of the drive spindle 2, and a locking thread 4. A disc-shaped tool 5 in form of a cutting disc is secured at the end of the drive spindle 2 with a clamping surface 6 of a locking nut 7 that is tightened on the locking thread 4. The locking thread 4 has a thread undercut 8. The thread undercut (8) is formed between a first thread section 4A remote from an end side 4C of the drive spindle 2 and a second thread section 4*b* located at the end surface 4C. The axial length of the undercut 8 corresponds at least to the length of the inner thread 9 of the locking nut 7. The clamping flange 3 forms a centering collar 10 which is partially received in an inner recess 11 of the locking nut 7.

Figure 2:
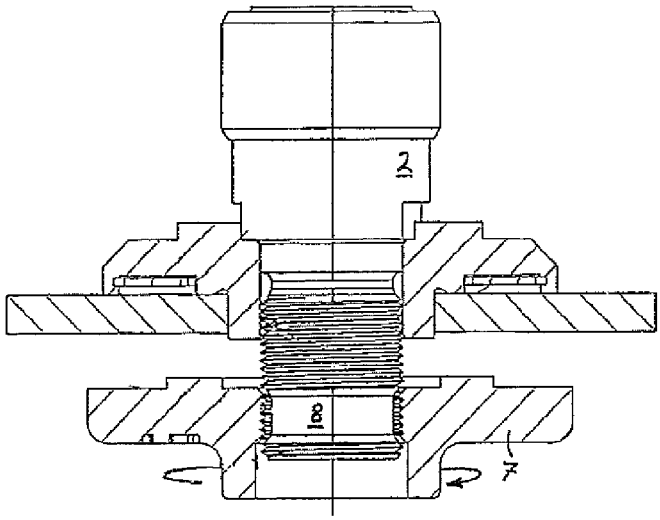
FIG. 2 a cross-sectional view showing the drive spindle with the disc-shaped tool with a detached nut.

As shown in FIG. 2, the inertia-induced free displacement of the locking nut 7, which is rotatable about the stationary drive spindle 2 is fixed within the thread undercut 8.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A hand-held power tool, comprising a drive spindle (2) rotatable about a rotational axis (A) and provided at a free end thereof with a clamping flange (3) and a locking thread (4) having at least one thread undercut (8) formed between a first thread section (4A) remote from the end side (4C) of the drive spindle (2) and a second thread section (4B) at the end side (4C) of the drive spindle (2); and a locking nut (7) having a clamping surface (6) and an inner thread (9), the locking nut (7) being tightenable on the locking thread (4) for securing a disc-shaped tool (5) between the clamping flange (3) of the drive spindle (2) and the clamping surface (6) of the locking nut (7), wherein the thread undercut (8) has an axial length that corresponds to at least an axial length of the inner thread (9) of the locking nut (7).

2. A hand-held power tool according to claim 1, wherein the clamping flange (3) has a centering collar (10).

3. A hand-held power tool according to claim 2, wherein the locking nut (7) has, on a side thereof adjacent to the disc-shaped tool (5), an inner recess (11) in which the centering collar (10) of the clamping flange (3) can be received.

4. A hand-held power tool according to claim 1, wherein an axial length of the first thread section (4A) is substantially greater than an axial length of the second thread section (4B).

* * * * *